US010482806B2

(12) United States Patent
Albrecht et al.

(10) Patent No.: US 10,482,806 B2
(45) Date of Patent: Nov. 19, 2019

(54) SPATIOTEMPORAL DITHERING TECHNIQUES FOR ELECTRONIC DISPLAYS

(71) Applicant: APPLE INC., Cupertino, CA (US)

(72) Inventors: Marc Albrecht, San Francisco, CA (US); David S. Zalatimo, San Jose, CA (US); Christopher P. Tann, San Jose, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 588 days.

(21) Appl. No.: 14/635,763

(22) Filed: Mar. 2, 2015

(65) Prior Publication Data

US 2016/0260387 A1 Sep. 8, 2016

(51) Int. Cl.
*G09G 3/20* (2006.01)

(52) U.S. Cl.
CPC ..... *G09G 3/2044* (2013.01); *G09G 3/2051* (2013.01); *G09G 3/2055* (2013.01); *G09G 2320/0271* (2013.01)

(58) Field of Classification Search
CPC ..... G06F 3/2044; G06F 3/2051
See application file for complete search history.

(56) References Cited

U.S. PATENT DOCUMENTS

| | | | | |
|---|---|---|---|---|
| 7,692,665 | B2 | 4/2010 | Daly et al. | |
| 8,847,868 | B2 | 9/2014 | Moon et al. | |
| 2010/0207959 | A1* | 8/2010 | Qi | G09G 3/2055 345/597 |
| 2013/0278585 | A1* | 10/2013 | Moon | G09G 3/36 345/212 |
| 2015/0194111 | A1* | 7/2015 | Slavenburg | G09G 3/3618 345/209 |

* cited by examiner

*Primary Examiner* — Kent W Chang
*Assistant Examiner* — Chayce R Bibbee
(74) *Attorney, Agent, or Firm* — Fletcher Yoder P.C.

(57) ABSTRACT

Devices and methods for reducing or eliminating spatiotemporal dithering image artifacts are provided. By way of example, a method includes providing positive polarity and negative polarity data signals to a plurality of pixels of a display during a first frame period, in which the first frame period corresponds a first spatiotemporal rotation phase. The method includes providing the positive polarity signals and the negative polarity signals to the plurality of pixels of the display during a second frame period, in which the second frame period corresponds a second spatiotemporal rotation phase. A spatiotemporal rotation phase sequence provided to the display comprises the first spatiotemporal rotation phase and the second spatiotemporal rotation phase. One of the first spatiotemporal rotation phase and the second spatiotemporal rotation phase of the spatiotemporal rotation phase sequence is altered during the first frame period or the second time period.

23 Claims, 9 Drawing Sheets

SPATIOTEMPORAL DITHERING TECHNIQUES FOR ELECTRONIC DISPLAYS

BACKGROUND

The present disclosure relates generally to spatiotemporal dithering, and more particularly, to spatiotemporal dithering in electronic displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (e.g., LCDs) are commonly used as screens or displays for a wide variety of electronic devices, including such consumer electronics as televisions, computers, and handheld devices (e.g., e.g., cellular telephones, audio and video players, gaming systems, and so forth). Such LCD devices typically provide a flat display in a relatively thin and low weight package that is suitable for use in a variety of electronic goods. In addition, such LCD devices typically use less power than comparable display technologies, making them suitable for use in battery powered devices or in other contexts where it is desirable to minimize power usage.

LCD devices typically include thousands (e.g., or millions) of picture elements, e.g., pixels, arranged in rows and columns. For any given pixel of an LCD device, the amount of light that viewable on the LCD depends on the voltage applied to the pixel. However, applying a single direct current (e.g., DC) voltage could eventually damage the pixels of the display. Thus, to prevent such possible damage, LCDs typically alternate, or invert, the voltage applied to the pixels between positive and negative DC values for each pixel.

To display a given color at a given pixel, the LCD device may receive 24-bits of image data, whereby 8-bits of data correspond to each of the primary colors of red, green, and blue. However, as the transition time for these displays have increased, pixels receiving 24-bits of data may not transition to a new color rapidly enough, which may lead to an undesired effect on the image termed "motion blurring." To minimize this motion blurring, response times of the LCDs may be increased. One manner in which to improve response times of the LCDs may include receiving 6-bits of data corresponding to each of the primary colors instead of 8-bits.

The reduction of data bits corresponding to colors may allow the pixels of the LCD to transition from one level to another more rapidly, however, it may also reduce the number of levels (e.g., e.g., colors) that each pixel may be able to render. To overcome this reduction in levels, dithering of the pixels may be performed. Dithering of the pixels may include applying slightly varying shades of color in a group of adjacent pixels to "trick" the human eye into perceiving the desired color, despite the fact that none of the pixels may be actually displaying the desired color.

The use of dithering may allow LCDs that receive 6-bit color data to simulate colors achievable by 8-bit color data LCDs. However, use of dithering may, in combination with the LCD inversion techniques discussed above, lead to generation of visible artifacts on the LCD. It may be useful to provide more advanced and improved image dithering techniques.

SUMMARY

Certain aspects commensurate with certain disclosed embodiments are set forth below. It should be understood that these aspects are presented merely to provide the reader with a brief summary of the disclosure and that these aspects are not intended to limit the scope of the disclosure or the claims. Indeed, the disclosure and claims may encompass a variety of aspects that may not be set forth below.

Devices and methods for reducing or eliminating spatiotemporal dithering image artifacts are provided. By way of example, a method includes providing positive polarity and negative polarity data signals to a plurality of pixels of a display during a first frame period, in which the first frame period corresponds a first spatiotemporal rotation phase. The method includes providing the positive polarity signals and the negative polarity signals to the plurality of pixels of the display during a second frame period, in which the second frame period corresponds a second spatiotemporal rotation phase. A spatiotemporal rotation phase sequence provided to the display comprises the first spatiotemporal rotation phase and the second spatiotemporal rotation phase. One of the first spatiotemporal rotation phase and the second spatiotemporal rotation phase of the spatiotemporal rotation phase sequence is altered during the first frame period or the second time period.

BRIEF DESCRIPTION OF THE DRAWINGS

Advantages of the disclosure may become apparent upon reading the following detailed description and upon reference to the drawings in which.

DETAILED DESCRIPTION

Figure 1:
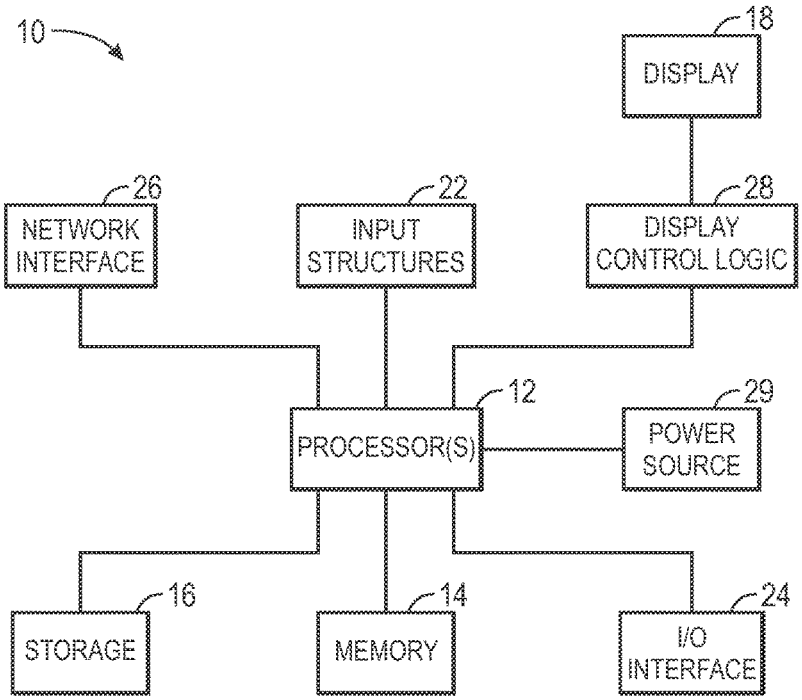
FIG. 1 is a schematic block diagram of an electronic device including display control circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure generally relate to spatiotemporal dithering and methods for reducing and/or substantially eliminating voltage or pixel charge imbalance, and, by extension, image artifacts that may be caused by spatiotemporal dithering. In certain embodiments, a graphics processor it may be used to periodically and/or aperiodically skip or alter one or more spatiotemporal dithering patterns or phases of a sequence of spatiotemporal patterns or phases corresponding to each frame of data stored to the pixels of a display. Specifically, sporadically (e.g., periodically or aperiodically) skipping or altering one or more spatiotemporal dithering patterns or phases of a predetermined sequence of spatiotemporal patterns or phases when driving the pixels of the display may reduce and/or substantially eliminate voltage and/or charge imbalance of the pixels of the display. Indeed, in some embodiments, the graphics processor may include a counter that is incremented with each frame of a data provided to the pixels of until a predetermined (e.g., static) or configurable (e.g., variable) charge threshold on the individual pixels of the display is reached. Once the pixel charge threshold is reached, the graphics processor may skip one or more spatiotemporal patterns or phases in the sequence or alter the sequence of the one or more spatiotemporal patterns or phases based on the pixel charge.

In some other embodiments, the graphics processor may include a timer that tracks the number of frames provided to the pixels of the display per unit time, and may be used to skip a frame or alter the sequence of spatiotemporal patterns or phases provided to the pixels of the display a number of times per unit time (e.g., skip a spatiotemporal phase or alter the sequence of spatiotemporal phases once or twice per minute). Still, in some other embodiments, the graphics processor may measure and monitor the pixel charge (e.g., monitor how closely the real-time pixel charge is approaching the configurable thresholds), and may skip a spatiotemporal phase or alter the sequence of spatiotemporal phases provided to the pixels of the display when the pixel charge approaches a pixel charge value less than a positive polarity pixel charge threshold value or greater than a negative polarity pixel charge threshold value. Specifically, the graphics processor may randomize the pixel charge threshold for which the skipping or alteration of the sequence of spatiotemporal phases may take place. In this way, the presently disclosed techniques may prevent the pixel charge from exceeding the physical charge characteristics of the pixels, and instead be limited to a nominal pixel charge value (e.g., pixel charge value within the operational characteristic bounds of the pixels). This may thus reduce and/or substantially eliminate voltage and/or charge imbalance of the pixels of the display, and, by extension, reduce and/or substantially eliminate image artifacts based thereon that may become apparent on the display.

With these features in mind, a general description of suitable electronic devices useful in reducing and/or substantially eliminating voltage or pixel charge imbalance due to spatiotemporal dithering is provided. Turning first to FIG. 1, an electronic device 10 according to an embodiment of the present disclosure may include, among other things, one or more processor(s) 12, memory 14, nonvolatile storage 16, a display 18 input structures 22, an input/output (e.g., I/O) interface 24, network interfaces 26, display control logic 28, and a power source 29. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

Figure 2:
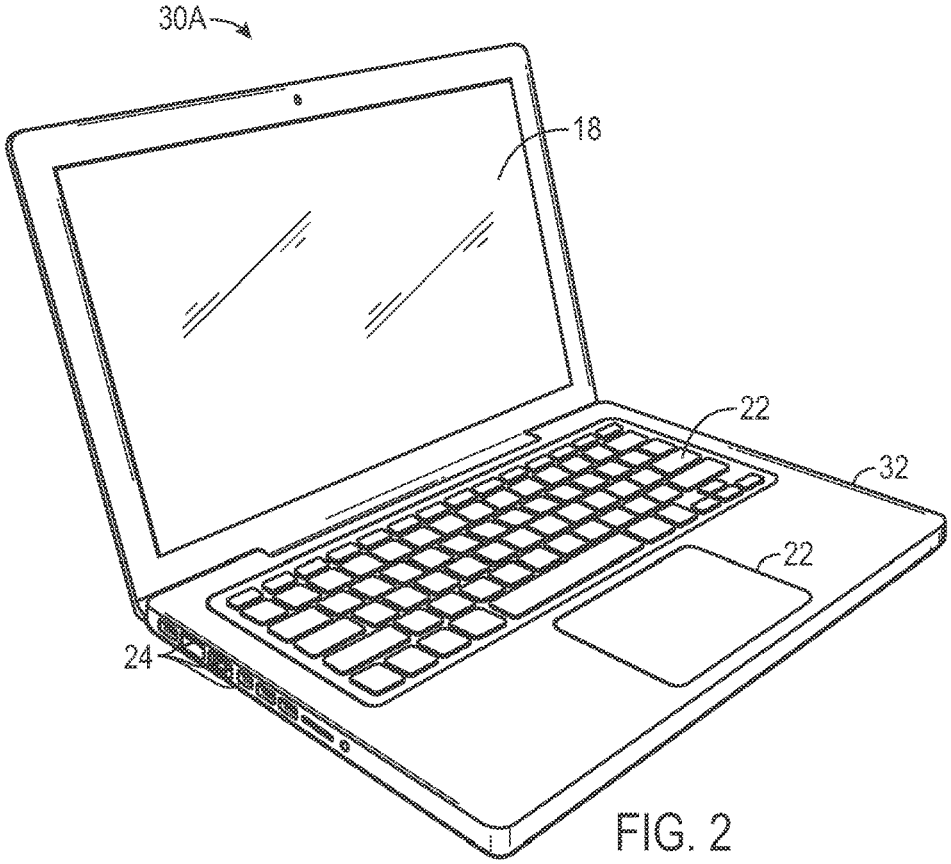
FIG. 2 is a perspective view of a notebook computer representing an embodiment of the electronic device of FIG. 1, in accordance with an embodiment.
Figure 3:
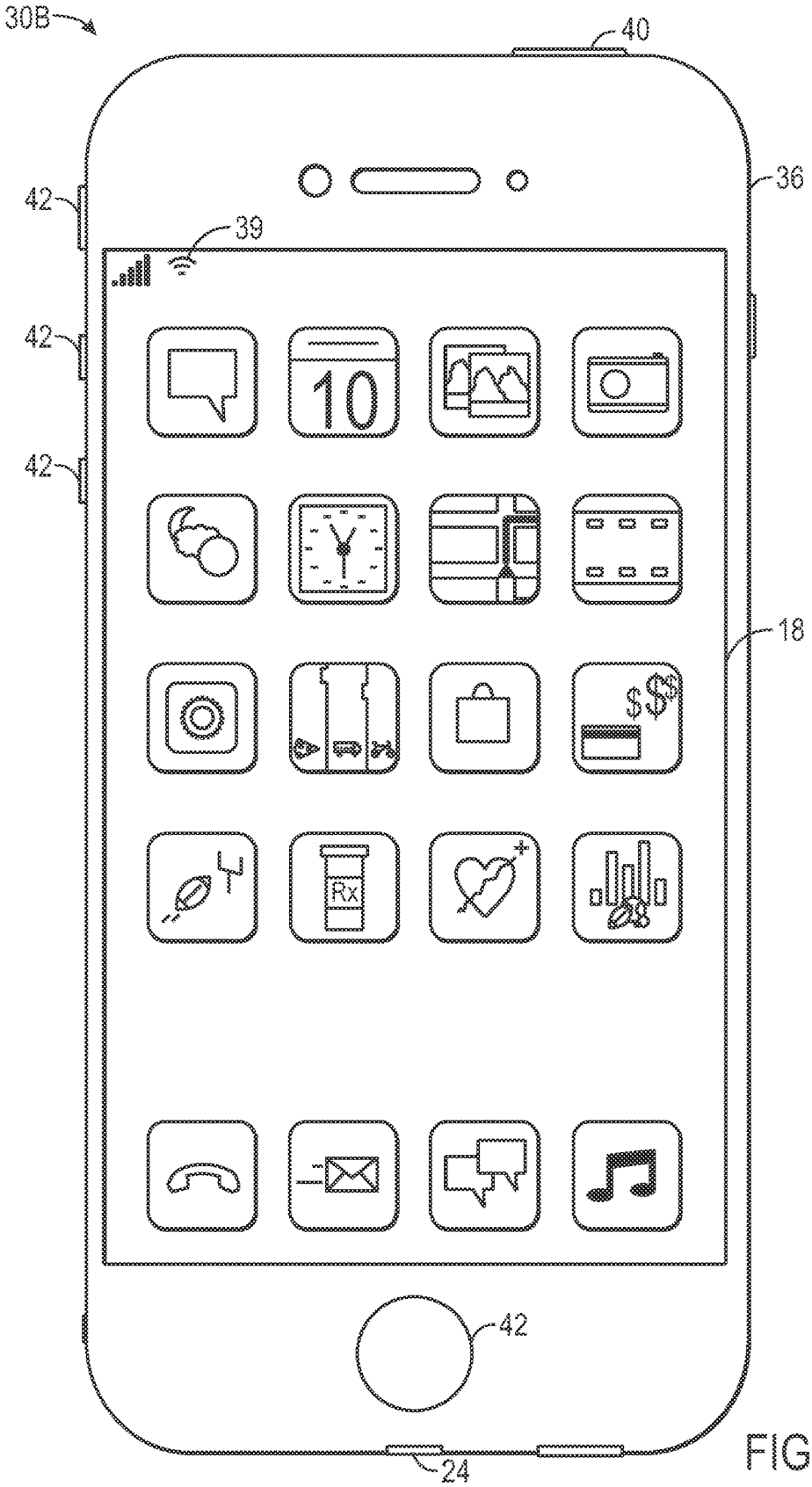
FIG. 3 is a front view of a hand-held device representing another embodiment of the electronic device of FIG. 1, in accordance with an embodiment.
Figure 4:
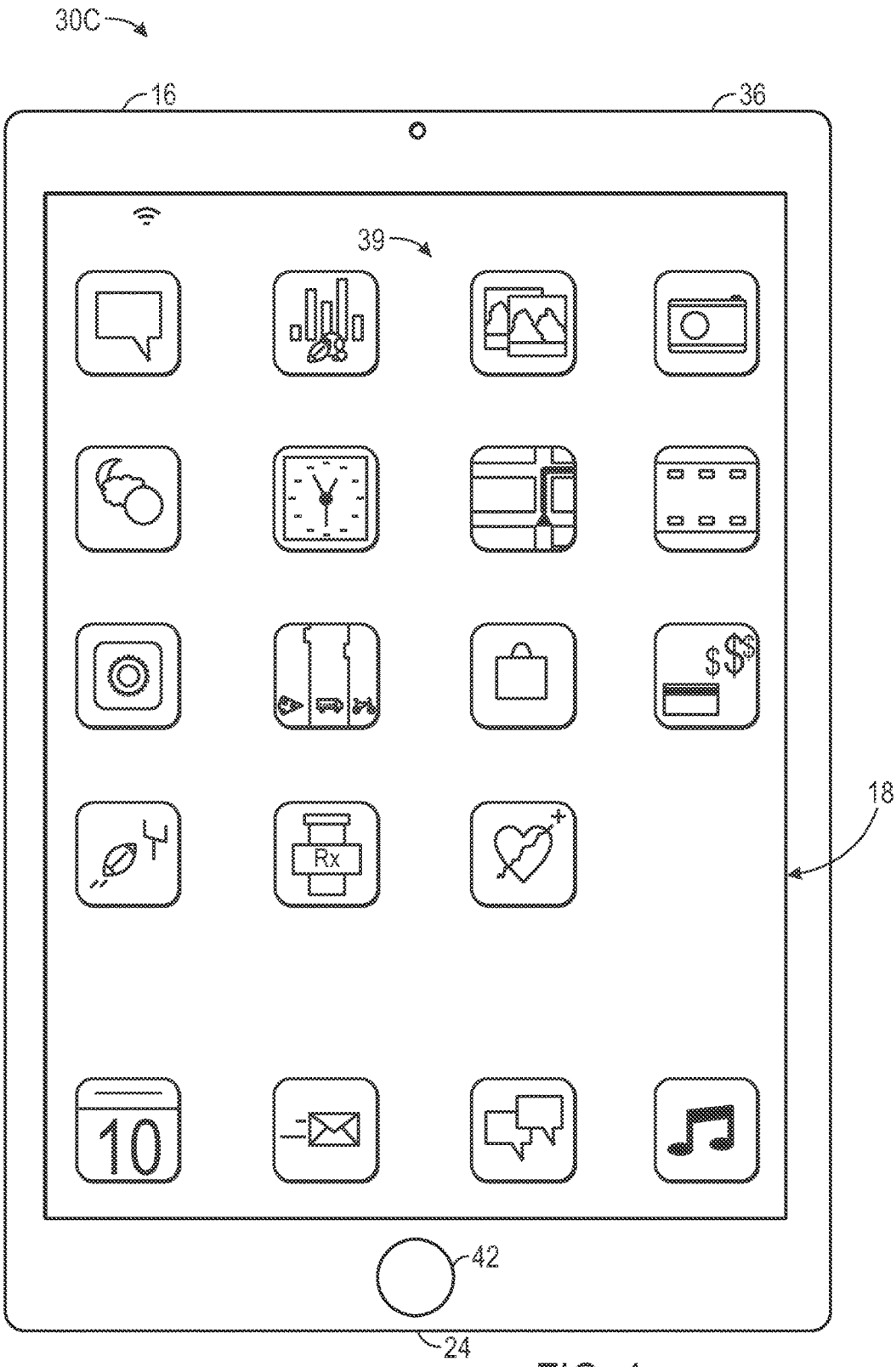
FIG. 4 is a front view of another hand-held device representing another embodiment of the electronic device of FIG. 1, in accordance with an embodiment.
Figure 5:
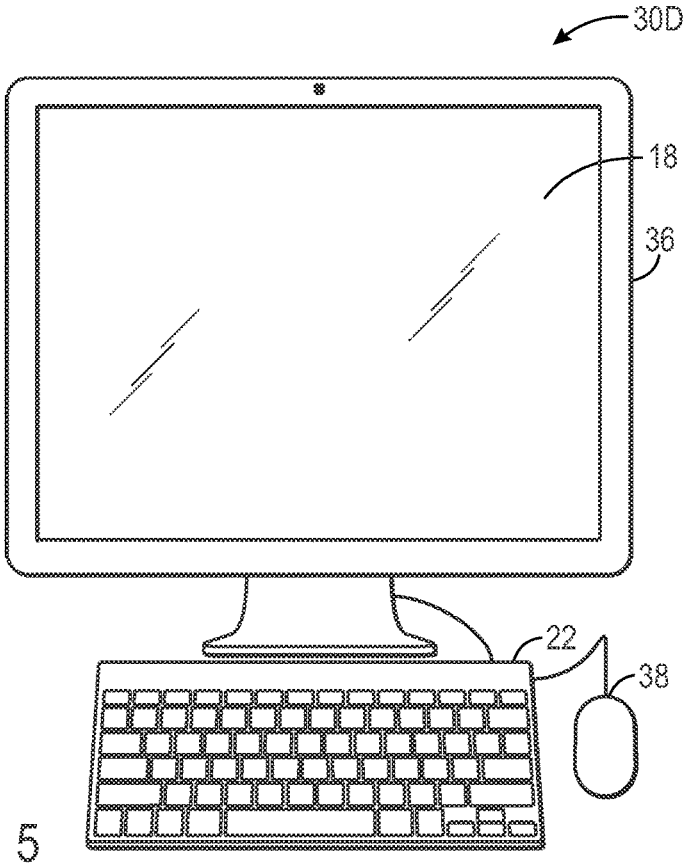
FIG. 5 is a front view of a desktop computer representing another embodiment of the electronic device of FIG. 1, in accordance with an embodiment.
Figure 6:
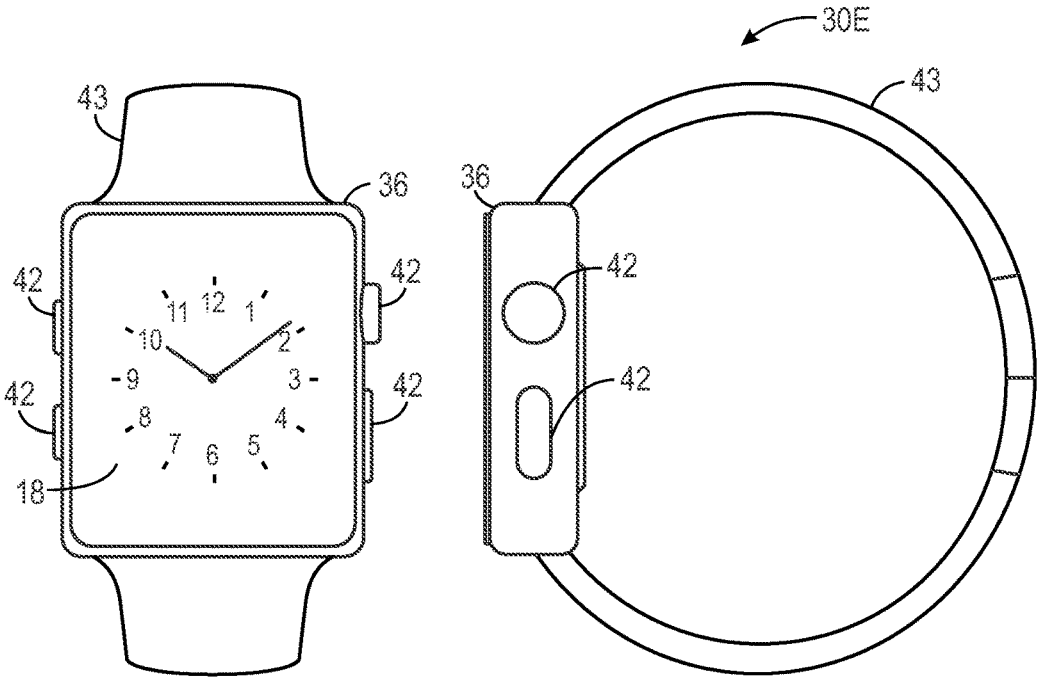
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (e.g., OLED) displays, or some combination of LCD panels and OLED panels.

The input structures 22 of the electronic device 10 may enable a user to interact with the electronic device 10 (e.g., e.g., pressing a button to increase or decrease a volume level). The I/O interface 24 may enable electronic device 10 to interface with various other electronic devices, as may the network interfaces 26. The network interfaces 26 may include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a $3^{rd}$ generation (e.g., 3G) cellular network, $4^{th}$ generation (e.g., 4G) cellular network, or long term evolution (e.g., LTE) cellular network. The network interface 26 may also include interfaces for, for example, broadband fixed wireless access networks (e.g., WiMAX), mobile broadband Wireless networks (e.g., mobile WiMAX), and so forth. As further illustrated, the electronic device 10 may include a power source 29. The power source 29 may include any suitable source of power, such as a rechargeable lithium polymer (e.g., Li-poly) battery and/or an alternating current (e.g., AC) power converter.

The internal components may further include display control logic 28. The display control logic 28 may be coupled to display 18 and to processor(s) 12. The display control logic 28 may be used to receive a data stream, for example, from processor(s) 12, indicative of an image to be represented on display 18. The display control logic 28 may be an application specific integrated circuit (e.g., ASIC), or any other circuitry for adjusting image data and/or generate images on display 18.

For example, in certain embodiments, the display control logic 28 may receive a data stream equivalent to 24 bits of data for each pixel of display 18, with 8-bits of the data stream corresponding to a level for each of the primary colors of red, blue, and green for each sub-pixel. The display control logic 28 may operate to convert these 24 bits of data for each pixel of display 18 to 18-bits of data for each pixel of display 18, that is, 6-bits of the data stream corresponding to a level for each of the primary colors of red, blue, and green for each sub-pixel. This conversion may, for example, include removal of the two least significant bits of each of the 8-bits of the data stream corresponding to a level for each of the primary colors of red, blue, and green. Alternatively, the conversion may, for example, include a look-up table or other means for determining which 6-bit data value should correspond to each 8-bit data input.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 38 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (e.g., USB), or other similar connector and protocol.

User input structures 40 and 42, in combination with the display 18, may allow a user to control the handheld device 30B. For example, the input structure 40 may activate or deactivate the handheld device 30B, one of the input structures 42 may navigate user interface to a home screen, a user-configurable application screen, and/or activate a voice-recognition feature of the handheld device 30B, while other of the input structures 42 may provide volume control, or may toggle between vibrate and ring modes. Additional input structures 42 may also include a microphone may obtain a user's voice for various voice-related features, and a speaker to allow for audio playback and/or certain phone capabilities. The input structures 42 may also include a headphone input to provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 36 may be provided to protect and enclose internal components of the computer 30D such as the dual-layer display 18. In certain embodiments, a user of the computer 30D may interact with the computer 30D using various peripheral input devices, such as the keyboard 22 or mouse 38, which may connect to the computer 30D via a wired and/or wireless I/O interface 24.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., e.g., pedometer, accelerometer, heart rate monitor), or other device by another manufacturer. The display 18 of the wearable electronic device 30E may include a touch screen (e.g., e.g., LCD, OLED display, active-matrix organic light emitting diode (e.g., AMOLED) display, and so forth), which may allow users to interact with a user interface of the wearable electronic device 30E.

Figure 7:
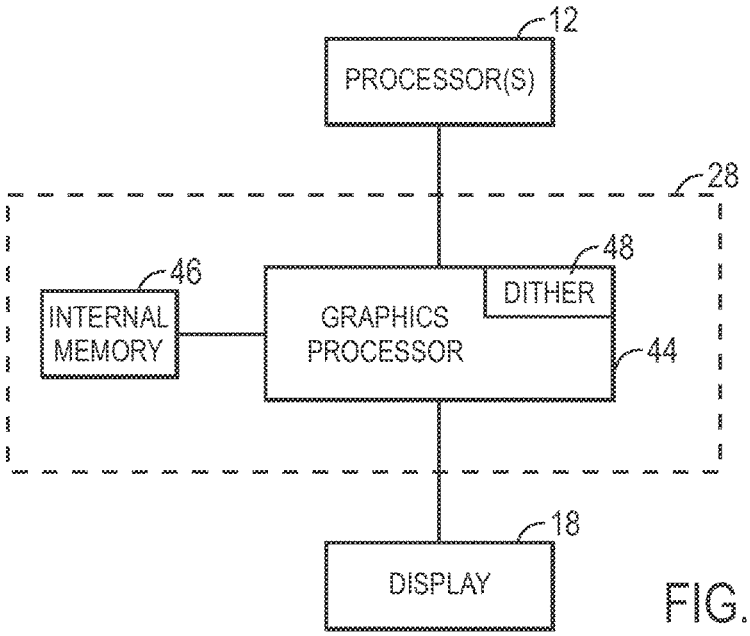
FIG. 7 is a block diagram illustrating components of display control circuitry of FIG. 1, in accordance with one embodiment.

FIG. 7 illustrates components of display control logic 28 of FIG. 1 in accordance with one or more embodiments. As illustrated, display control logic 28 may be positioned between processor(s) 12 and display 18. The display control logic 28 may include graphics processor 44 that may operate to generate images on display 18 of electronic device 10. The graphics processor 44 may be a device that receives pixel intensity levels from processor(s) 12 and may transmit signals corresponding to those pixel intensity levels to display 18. As set forth above, the received pixel intensity levels, e.g. an image code from processor(s) 12, may be a 24-bit data stream and the transmitted voltage levels, e.g., an image code for display on display 18, may correspond to an 18-bit data stream (e.g., when, for example, LCD 20 is a 6-bit display). The pixel intensity levels transmitted to display 18 may be, for example, numerical levels that correspond to respective pixel intensities to be shown on display 18. The display 18 may thus receive the voltage signals from graphics processor 44 as input signals, and may produce an image corresponding to the received voltage signals. The manner in which an image is produced as described below.

In certain embodiments, the graphics processor 44 may, for example, utilize internal memory 46 in performing the functions required by display control logic 28. One of the functions of internal memory 46 may be the storage of a look-up table utilized by graphics processor 44 to convert the received 24-bit data stream into an 18-bit data stream for display on the 6-bit display 18. Another function of internal memory 46 may be to store an algorithm corresponding to a dithering technique to be performed by graphics processor 44. This algorithm may allow for the dithering of the pixels of display 18. For example, the dithering algorithm may be computer code adapted to be stored in internal memory 46 and to be operated on by graphics processor 44 to illuminate a small grouping of pixels, such as four pixels, with slightly varying shades of color that "trick" the human eye into perceiving the desired color, despite the fact that the small group of pixels may not be actually displaying the desired color.

In certain embodiments, the graphics processor 44 may include dithering circuitry 48, or dithering circuitry 48 may be located external to graphics processor 44 either in or outside of display control logic 28. The dithering circuitry 48 may be used to perform dithering of the pixels in display 18 in a manner substantially similar to that described above. Furthermore, graphics processor 44 may also perform inversion techniques in the pixels of display 18. For example, the inversion techniques may be stored as computer readable code adapted to be stored in internal memory 46 and to be operated on by graphics processor 44 to perform inversion of pixels in display 18. In certain embodiments, the dithering circuitry 48 of the graphics processor 44 may, in conjunction with internal memory 46, perform spatiotemporal dithering as will be further appreciated with respected to FIGS. 8-13.

Figure 8:
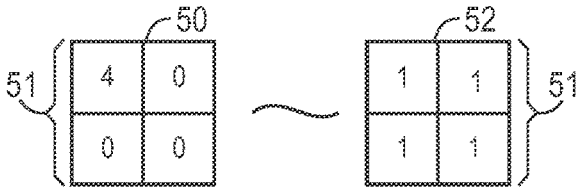
FIG. 8 is a diagram of a two dimensional grid of pixels utilizing spatial dithering in accordance with an embodiment.

FIG. 8 illustrates four-pixel grid 50 for use with 6-bit LCD display 18. The four pixel grid 50 may be utilized to simulate an 8-bit LCD color display via dithering. The simulated (e.g., resultant) colors for an 8-bit LCD display are illustrated by four-pixel grid 52. It should be noted that while only four pixels are illustrated in FIG. 7, this pattern of pixel arrangement may be reproduced for the entire display 18, for example, in groups of four pixels arranged into 2-dimensional grids.

For example, as illustrated in FIG. 8, the four-pixel grid 40 may include an intensity level of "4" in the upper left quadrant of a two-by-two pixel grid. The remaining quadrants of four-pixel grid 40 may be illustrated with intensity levels or gray levels of "0." The grid levels may, for example, correspond to intensity levels of LCD display 18. For example, an intensity level of "0" may correspond to the darkest possible color (e.g., black), while "63" may correspond to the brightest color available (e.g., white) for a 6-bit display 18. The remaining levels between "0" and "63" may correspond to the available gray levels and/or colors that may be displayed at any given pixel 51 location. Conversely, in an 8-bit LCD display, "0" may correspond to black while "255" may correspond to white, with the remaining levels between "0" and "255" corresponding to the available gray levels and/or colors that may be displayed at any given pixel location. For example, in a 6-bit display, $2^6$ colors, or levels, may be available for display while in the 8-bit display, $2^8$ colors may be available for display.

In certain embodiments, to help approximate the extra colors available for display in the 8-bit display, spatial dithering of four bit pixel grid 50 in the 6-bit display 18 may be performed. For example, to approximate four pixels 51 having intensity levels of "1," as illustrated in four pixel grid 52, the four pixel grid 50 may include an intensity level of "4" in the upper left quadrant, as well as three intensity levels of "0" in the remaining quadrants. The combined intensity level of these quadrants is "4." Similarly, the combined intensity level of an 8-bit display displaying intensity levels of "1" at each of the pixels 51 would also be "4." Therefore, when viewed at a distance, a user may see the overall value of four pixel grid 50 of the 6-bit display 18 as approximating an 8-bit display displaying pixel intensities of "1," as illustrates in four pixel grid 52.

Figure 9:
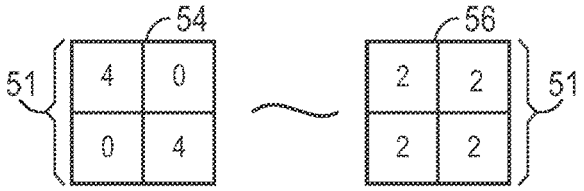
FIG. 9 is a diagram of a two dimensional grid of pixels utilizing spatial dithering in accordance with an embodiment.

FIG. 9 depicts a second example of spatial dithering. As depicted, FIG. 9 includes intensity levels of "4" in the upper leftmost quadrant and the lower rightmost quadrant of four pixel grid 54, for a total intensity value of "8." Similarly, the combined intensity level of an 8-bit display displaying intensity levels of "2" at each of the pixels would also be "8." FIG. 9 also illustrates the approximate grid generated by four pixel grid 54 of the 6-bit display 18, as shown in four pixel grid array 56 approximately displaying pixel intensity values of "2" at each pixel 51. Accordingly, the four pixel grid 54 of FIG. 9 may approximate to a user as a distance an average intensity level of "2" for the four pixels of four pixel grid 54, thus simulating a four pixel grid for an 8-bit LCD display displaying an intensity of "2" at each pixel 51.

Figure 10:
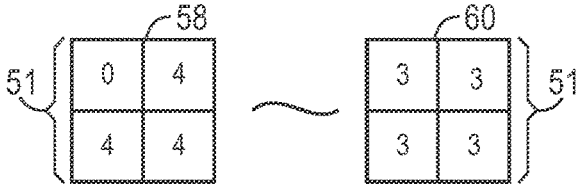
FIG. 10 is a diagram of a two dimensional grid of pixels utilizing spatial dithering, in accordance with an embodiment.

In a similar example, FIG. 10 illustrates another example of dithering for use with 6-bit LCD display 18. The four pixel grid 58 illustrated in FIG. 10 includes an intensity level of "0" in the upper leftmost quadrant along with intensity levels of "4" in all remaining quadrants. This leads to a total pixel 51 intensity of "12," which, in a similar manner to that described above, which may be approximated as four pixel grid 60 displaying pixels 51 each at an intensity of "3" in each quadrant. Thus, to a user viewing the electronic device 10 from a distance, the four pixel grid 50 of FIG. 10 may approximate the intensity of an 8-bit display displaying intensity values of "3" in each pixel 51.

Figure 11:
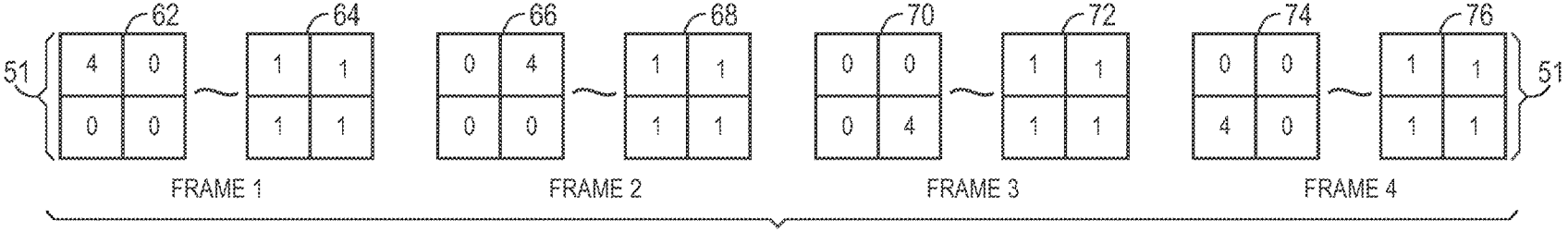
FIG. 11 is a diagram of a two dimensional grid of pixels utilizing temporal dithering over four frames, in accordance with an embodiment.

In certain embodiments, it may be useful to apply temporal dithering in conjunction with spatial dithering (e.g., spatiotemporal dithering). For example, FIG. 11 illustrates an example of temporal dithering. The temporal dithering may include, for example, spatial dithering intensities illustrated in four pixel grid 50 of FIG. 8. Indeed, any of the spatial dithering processes discussed above with respect to FIGS. 8-10 may be utilized in conjunction with the temporal dithering illustrated in FIG. 11. FIG. 11 illustrates a four pixel grid 62 of a 6-bit display 18 that is utilized to approximate an intensity level of "1" for each pixel 51 by incorporating an intensity level of "4" along with three intensity levels of "0" as illustrated, for example, by the four pixel grid 64.

In Frame 1, the intensity level of "4" in four pixel grid 62 is in the upper leftmost quadrant. As discussed above, if the intensity level of "4" is maintained in this position in four pixel grid 62, a user may be able to view the difference in brightness in the upper left hand corner of four pixel grid 62 as an artifact. Accordingly, in Frame 2, utilization of temporal dithering may allow for the "rotation" of the intensity level of "4" to the upper rightmost quadrant of four pixel grid 66. This "rotation" may include changing the voltage supplied to the pixel 51 in the upper leftmost quadrant to generate a "0" level, while changing the voltage supplied to the pixel 51 in the upper rightmost quadrant to generate an intensity level of "4." In Frame 3, temporal dithering may be utilized to rotate the pixel 51 intensity of "4" to the bottom right hand quadrant of four pixel grid 70. Finally, in Frame 4, the temporal dithering may cause the pixel 51 intensity level of "4" to rotate to the bottom left hand quadrant of four pixel grid 74.

Thus, as can be seen in FIG. 11, in each of Frame 1, Frame 2, Frame 3, and Frame 4, the total intensity value of the four pixel grids 62, 66, 70 and 74 is approximately equivalent to intensity levels of "1" in each of the quadrants of the four pixel grids 64, 68, 72, and 76. However, because the intensity level of "4" is rotated amongst the quadrants of four pixel grid 62, any brightness due to the intensity of a single quadrant being higher than the remaining quadrants is balanced across the four quadrants of four pixel grids 62, 66, 70, and 74 over each of the four frames. This rotation of the higher intensity level may operate to blend the overall intensity of four pixel grid 62. Furthermore, when this technique is applied to groups of pixel grids in display 18, a more uniform image may be displayed to the user.

Figure 12:
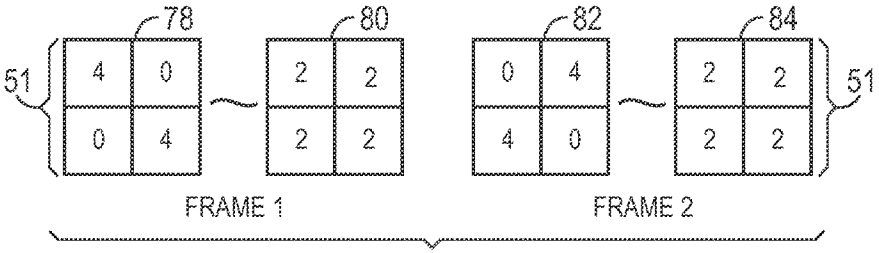
FIG. 12 is a diagram of a two dimensional grid of pixels utilizing temporal dithering over two frames, in accordance with an embodiment.

FIG. 12 illustrates another example of the temporal dithering discussed above with respect to FIG. 11, with two pixels 51 being driven with a first intensity and two pixels 51 being driven with a second intensity. For example, the four pixel grid 78 of FIG. 12 may be analogous to four pixel grid 54 illustrated with respect to FIG. 9. For example, four pixel grid 78 of FIG. 12 may be used to approximate intensity levels of "2" for each pixel, as shown in four pixel grid 80. As such, in Frame 1 of FIG. 8, intensity levels of "4" may be displayed in the upper leftmost and lower rightmost quadrants of four pixel grid 78. Subsequently, in Frame 2, the intensity levels of "4" may be rotated to the upper rightmost and lower leftmost quadrants of four pixel grid 82.

Thus, in both Frame 1 and Frame 2, the four pixel grids 78 and 82 may have an overall pixel 51 intensity value of "8" which, to a user, may approximate four pixels having intensity levels of "2," as illustrated in the four pixel grids 80 and 84. Moreover, by rotating the intensities across the quadrants of the four pixel grids 78 and 82, any brightness due to the intensity of a two quadrants having higher intensities than the remaining quadrants is balanced across the four quadrants of four pixel grids 78 and 82 over two frames. It should be noted that the rotation illustrated in Frame 1 may be repeated for Frame 3 and any subsequent odd frames, while the rotation illustrated in Frame 2 may be repeated for Frame 4 and any subsequent even frames.

Figure 13:
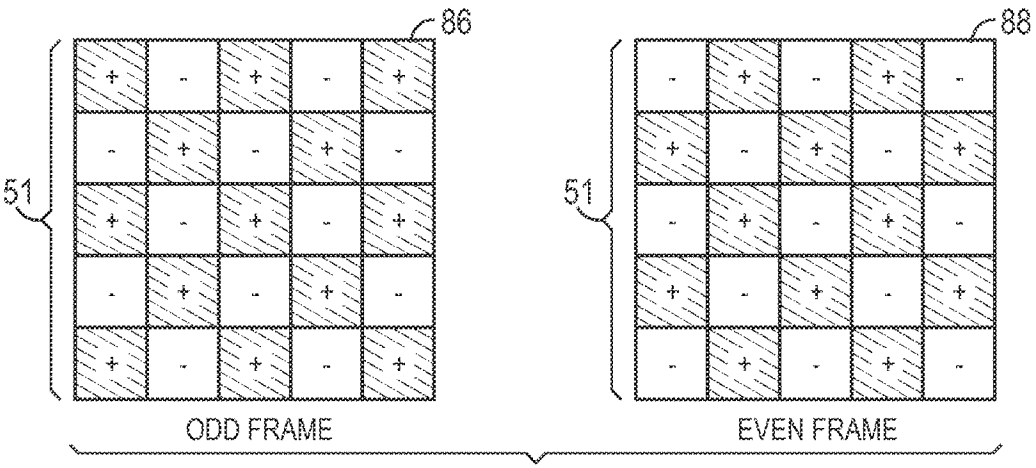
FIG. 13 is a diagram of a two dimensional grid of pixels utilizing dot inversion over two frames, in accordance with an embodiment.

Thus, as depicted in both FIGS. 11 and 12, temporal dithering may reduce any artifacts due to isolated brightness of pixels in four pixel grids. However, as described above, dithering in display 18 is not utilized alone, but rather, in conjunction with an inversion of pixels in display 18. FIG. 13 illustrates a first inversion method that may be used in display 18. For example, an odd frame pixel grid 86 may be a portion of the display 18 and that utilizes a dot inversion and/or pixel inversion method. During the odd frame, the odd frame pixel grid 86 may include 5×5 pixels 51, each with a corresponding voltage applied to the pixels 51. The applied voltage to the pixels 51 of the display 18 may alternate between a positive voltage polarity (e.g., $+V_{pixel}$) and a negative voltage polarity (e.g., $-V_{pixel}$) on a pixel by pixel basis. For example, the top most row, the third row, and the fifth rows (e.g., rows 1, 3, and 5 of the odd frame pixel grid 86) may include a number of pixels 51 that may receive a positive voltage polarity (e.g., along columns 1, 3, and 5) and a negative voltage polarity (e.g., along columns 2 and 4 of the pixel grid 86). On the other hand, the second and fourth rows (e.g., rows 2 and 4 of odd frame pixel grid 86) may include five pixels 51 that receive a positive voltage polarity (e.g., along columns 2 and 4 of the pixel grid 86) and a negative voltage polarity (e.g., along columns 1, 3, and 5 of the even pixel grid 86).

As further illustrated in FIG. 13, during an even frame, rows 1, 3, and 5 of an even frame pixel grid 88, may include a number of pixels 51 that receive a positive voltage polarity (e.g., in columns two and four of the even frame pixel grid 88) and a negative voltage polarity (e.g., in columns 1, 3, and 5 of the even frame pixel grid 88). On the other hand, the second and fourth rows (e.g., rows 2 and 4 of the even frame pixel grid 88) may include five pixels that receive a positive voltage (e.g., along columns 1, 3 and 5 of the even frame pixel grid 88) and a negative voltage (e.g., rows 2 and 4 of the even frame pixel grid 88) during the even frame. Specifically, during the even frame, each of the pixels 51 previously driven with a positive voltage polarity in the odd frame may be each then driven with negative voltage polarity, and vice versa.

Figure 14:
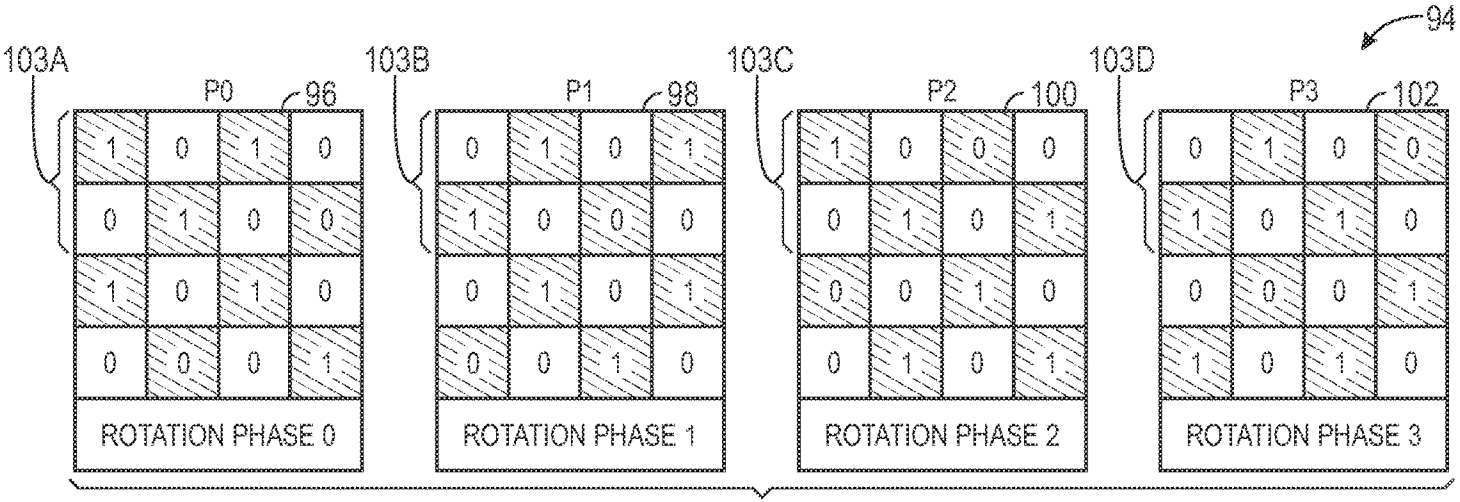
FIG. 14 is a diagram of a two dimensional grid of pixels illustrating a spatiotemporal dithering rotation phase sequence over four frames, in accordance with an embodiment.

However, in some embodiments, utilizing spatiotemporal dithering and pixel inversion techniques as discussed above, for example, with respect to FIGS. 8-13, may lead to undesirable image artifacts becoming apparent on the display 18. For example, as depicted in FIG. 14, a spatiotemporal dithering rotation phase sequence 94 may include a spatiotemporal dithering rotation phase 96 (e.g., "Phase 0" or "P0"), a spatiotemporal dithering rotation phase 98 (e.g., "Phase 1" or "P1"), a spatiotemporal dithering rotation phase 100 (e.g., "Phase 2" or "P2"), and a spatiotemporal dithering rotation phase 102 (e.g., "Phase 3" or "P3"). It should be appreciated that the spatiotemporal dithering rotation phases 96, 98, 100, and 102 of the spatiotemporal dithering rotation phase sequence 94 are included merely for the purpose of illustration. In other embodiments, the spatiotemporal dithering rotation phase sequence 94 (e.g., P0>P1>P2>P3) may include any number of rotation phase sequences, which may further include any of various spatiotemporal dithering patterns. For example, as further illustrated in FIG. 14, the spatiotemporal dithering rotation phase 96 (e.g., "Phase 0" or "P0") may correspond to an odd frame, and may include intensity levels of "1" in the upper leftmost pixel 51 and the lower rightmost pixel 51 of the upper leftmost and the lower rightmost quadrants of the spatiotemporal dithering rotation phase 96. This pattern may correspond to a total intensity value of approximately "0.5" for the upper leftmost and the lower rightmost quadrants of the spatiotemporal dithering rotation phase 96.

Similarly, the lower leftmost and the upper rightmost quadrants of the may include an intensity level of "1" in the upper left pixel 51 and three intensity levels of "0" in the remaining pixels 51, respectively. The combined intensity level of these quadrants is approximately "0.25." The spatiotemporal dithering rotation phase 98 (e.g., "Phase 1" or "P1") may correspond to an even frame, and may include intensity levels of "1" in the upper rightmost pixel 51 and the lower leftmost pixel 51 of the upper leftmost and the lower rightmost quadrants of the spatiotemporal dithering rotation phase 98. This pattern may correspond to a total intensity value of approximately "0.5" for the upper leftmost and the lower rightmost quadrants of the spatiotemporal dithering rotation phase 98. The lower leftmost and the upper rightmost quadrants of the may include an intensity level of "1" in the upper left pixel 51 and three intensity levels of "0" in the remaining pixels 51, respectively. The combined intensity level of these quadrants is approximately "0.25." As further illustrated, the spatiotemporal dithering rotation phases 100 and 102 may correspond to the spatiotemporal dithering rotation phases 96 and 98 for the next odd and even frames in the spatiotemporal dithering rotation phase sequence 94, respectively.

In certain embodiments, as further depicted by FIG. 14, four pixel grids 103A, 103B, 103C, and 103D may approximate an intensity level of four pixels each equivalent to "0.5." It should be appreciated that only the four pixel grids 103A, 103B, 103C, and 103D are highlighted for the purpose of illustration, the present techniques and/or effects may also apply to other four pixel grids of the spatiotemporal dithering rotation phase 96 (e.g., "Phase 0" or "P0"), the spatiotemporal dithering rotation phase 98 (e.g., "Phase 1" or "P1"), the spatiotemporal dithering rotation phase 100 (e.g., "Phase 2" or "P2"), and the spatiotemporal dithering rotation phase 102 (e.g., "Phase 3" or "P3"). For example, in the spatiotemporal dithering rotation phase 96 (e.g., "Phase 0" or "P0") of FIG. 14, two of the pixels 51 in the four pixel grid 103A display an intensity level of "1" in the upper left hand and lower right hand quadrants of the four pixel grid 103A. Further, as illustrated, the upper left hand and lower right hand quadrants of the four pixel grid 103A may be driven with positive voltages (as illustrated by the shaded regions of the four pixel grid 103A).

In the spatiotemporal dithering rotation phase 98 (e.g., "Phase 1" or "P1"), the pixels 51 that displays the intensity level of "1" may be in the lower left hand and upper right hand quadrants of the four pixel grid 103B. Due to the pixel inversion method of providing positive voltage signals to rows one and three of column two during even frames, the pixel intensity of "1" in the upper and rightmost quadrants again receives a positive polarity voltage value when driven to its intensity level. As the pixel intensity level of "1" is positioned in the upper leftmost and lower rightmost quadrants of the four pixel grid 103C in spatiotemporal dithering rotation phase 100 (e.g., "Phase 2" or "P2"), the pixel intensity level of "1" in the lower rightmost quadrant of the four pixel grid 103C is shown as being driven with a negative polarity voltage value. Similarly, in the spatiotemporal dithering rotation phase 102 (e.g., "Phase 3" or "P3"), the intensity level of "1" in the lower leftmost quadrant of the four pixel grid 103D is driven with a negative intensity.

In certain embodiments, the pixel intensity level is driven with positive polarity voltages for one or more frames and with negative polarity voltages for one or more frames. However, the positive and negative polarity voltages used to drive the pixels 51 may not be identical in voltage magnitude, as the voltages tend to differ slightly. For example, if the pixels 51 are intended to be driven to a +3V voltage and a −3V voltage, the +3V (positive polarity) voltage may be actually driven at 3.1V. Similarly, the −3V (negative polarity) voltage may actually be driven at −2.9V. Because the magnitudes of the positive and negative polarity driving voltages typically differ, and because the pixel intensity level of "1" is driven by a positive polarity voltage in the top most half of four pixel grid 48 and driven by negative polarity voltage in the lower most half of four pixel grids 103A, 103B, 103C, and 103D, differences in brightness on display 18 may become apparent to a user of the electronic device 10. These differences in brightness may result in undesirable image artifacts becoming apparent on the display 18.

Accordingly, in certain embodiments, in addition to providing spatiotemporal dithering and pixel inversion techniques, it may be useful to provide techniques to periodically and/or aperiodically skip (e.g., generating a spatiotemporal dithering sequence of P0>P2>P3>P0>P1>P2>P3 . . . as opposed to P0>P1>P2>P3>P0>P1>P2>P3 . . . ) or alter the sequence of one or more spatiotemporal dithering patterns or phases of a sequence of spatiotemporal patterns or phases corresponding to each frame of data stored to the pixels 51 of the display 18. Specifically, as will be further appreciated, sporadically (e.g., periodically or aperiodically) skipping or altering one or more spatiotemporal dithering patterns or phases of a predetermined sequence of spatiotemporal patterns or phases when driving the pixels 51 of the display 18 may reduce and/or substantially eliminate voltage and/or charge imbalance of the pixels 51 of the display 18. Indeed, as will be further appreciated with respect to FIGS. 16 and 17, in some embodiments, the graphics processor 44 and/or dithering circuitry 48 may include a counter that is incremented with each frame of a data provided to the pixels 51 of the until a predetermined (e.g., static) or configurable (e.g., variable) charge threshold on the individual pixels 51 of the display 18 is reached. Once the pixel charge threshold is reached, the graphics processor 44 and/or dithering circuitry 48 may skip one or more spatiotemporal patterns or phases in the sequence or alter the sequence of the one or more spatiotemporal patterns or phases based on the pixel charge.

In some other embodiments, the graphics processor 44 and/or dithering circuitry 48 may include a timer that tracks the number of frames provided to the pixels 51 of the display 18 per unit time, and may be used to skip a frame or alter the sequence of spatiotemporal patterns or phases provided to the pixels 51 of the display 18 a number of times per unit time (e.g., skip a spatiotemporal phase or alter the sequence of spatiotemporal phases once or twice per period of time, e.g., one minute). Still, in some other embodiments, the graphics processor 44 and/or dithering circuitry 48 may measure and monitor the pixel charge (e.g., monitor how closely the real-time pixel charge is approaching the configurable thresholds), and may skip a spatiotemporal phase or alter the sequence of spatiotemporal phases provided to the pixels 51 of the display 18 when the pixel charge approaches a pixel charge value less than a positive polarity pixel charge threshold value or greater than a negative polarity pixel charge threshold value. That is, the graphics processor 44 and/or dithering circuitry 48 may randomize the pixel charge threshold for which the skipping or alteration of the sequence of spatiotemporal phases may take place. In this way, the presently disclosed techniques may prevent the pixel charge from exceeding the physical charge characteristics of the pixels 51, and instead be limited to a nominal pixel charge value (e.g., pixel charge value within the operational characteristic bounds of the pixels 51). This may thus reduce and/or substantially eliminate voltage and/or charge imbalance of the pixels 51 of the display 18, and, by extension, reduce and/or substantially eliminate image artifacts based thereon that may become apparent on the display 18.

Figure 15:
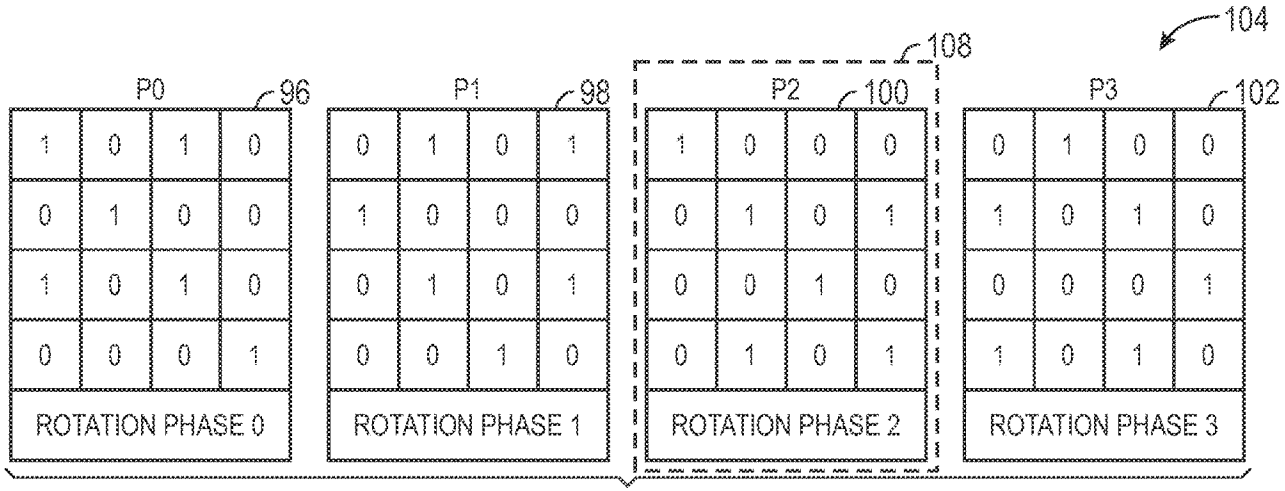
FIG. 15 is a diagram of a two dimensional grid of pixels illustrating the skipping of a spatiotemporal dithering rotation phase, in accordance with an embodiment.

In certain embodiments, as depicted by FIG. 15, the graphics processor 44 and/or dithering circuitry 48 may periodically and/or aperiodically skip one or more of the spatiotemporal dithering rotation phases 96, 98, 100, and 102 of the sequence 94 (e.g., P0>P1>P2>P3). For example, as further illustrated by FIG. 15, a spatiotemporal dithering rotation phase sequence 104 may include a skipped or altered (e.g., P2 is skipped such that the spatiotemporal dithering sequence P0>P1>P2>P3>P0>P1>P2>P3 . . . is altered to a spatiotemporal dithering sequence P0>P1>P3>P0>P1>P2>P3 . . . ) spatiotemporal dithering rotation phase pattern (e.g., as illustrated by dashed line 108). Specifically, instead of providing each of the spatiotemporal dithering rotation phases 96, 98, 100, and 102 of the rotation phase sequence 94 (e.g., P0>P1>P2>P3) as discussed above with respect to FIG. 14, the graphics processor 44 and/or dithering circuitry 48 may skip (e.g., omit one or more spatiotemporal dithering phases in lieu of one or more other spatiotemporal dithering phases of the sequence of spatiotemporal dithering phases, and then returning to the standard spatiotemporal dithering rotation phase sequence P0>P1>P2>P3>P0>P1>P2>P3 . . . ) the spatiotemporal dithering rotation phase 98 (e.g., as illustrated dashed outline 108) as the pixels 51 of the display 18 are refreshed to compensate for any pixel charge imbalance between the pixels 51 of the display 18.

Figure 16:
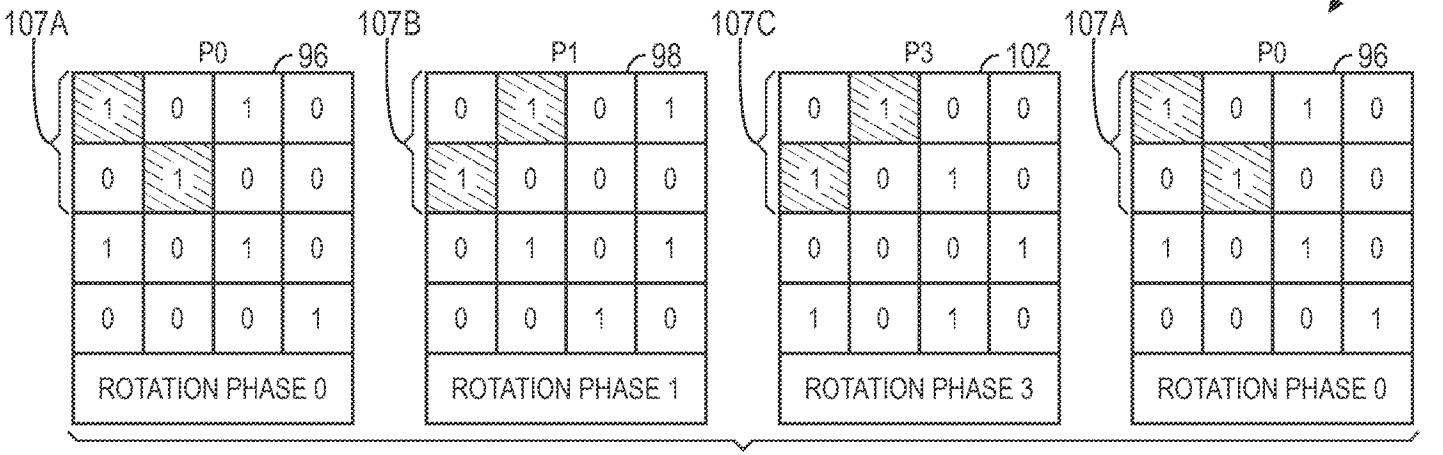
FIG. 16 is a diagram of a two dimensional grid of pixels illustrating a resulting spatiotemporal dithering rotation phase sequence over four frames, in accordance with an embodiment.

For example, as depicted in FIG. 16, the graphics processor 44 and/or dithering circuitry 48 may produce a standard spatiotemporal dithering rotation phase sequence 106 (e.g., P0>P1>P3>P0). As discussed above with respect the sequence 94, the spatiotemporal dithering rotation phase sequence 106 (e.g., P0>P1>P3>P0) is included merely for the purpose of illustration. In other embodiments, the graphics processor 44 and/or dithering circuitry 48 may skip any number of the spatiotemporal dithering rotation phases 96, 98, 100, and 102 (e.g., 1, 2, 3, or more rotation phases over 4 frames, 1, 2, 3, 4, 5, 6, or more rotation phases over 8 frames, and so forth) as the pixels 51 of the display 18 are refreshed. Similarly, any of the spatiotemporal dithering rotation phases 96, 98, 100, and 102 may be skipped, and the specific rotation phase 96, 98, 100, and 102 that is skipped for one frame sequence may vary as a new frame sequence begins.

For example, in certain embodiments, the graphics processor 44 and/or dithering circuitry 48 may generate a spatiotemporal dithering rotation phase sequence 106 that includes P0>P1>P3, and then returning to the standard sequence, P1>P2>P0, and then returning to the standard sequence, P1>P2>P3, and then returning to the standard sequence, P0>P2>P3, and then returning to the standard sequence, and so forth, in which the spatiotemporal dithering rotation phases 96, 98, 100, and 102 that is skipped varies and/or remains unchanged over of each the frame sequences. Furthermore, as will be further appreciated with respect to FIG. 17, the graphics processor 44 and/or dithering circuitry 48 may periodically and/or aperiodically skip one or more of the spatiotemporal dithering rotation phases 96, 98, 100, and 102 based, for example, a predetermined or configurable pixel charge threshold, a number of frames provided to the pixels 51 of the display 18 per unit time, or based on a randomized pixel charge threshold for which the skipping or alteration of the sequence of spatiotemporal dithering rotation phases 96, 98, 100, and 102 may take place.

For example, by applying the present techniques of periodically and/or aperiodically skipping one or more spatiotemporal dithering rotation phases 96, 98, 100, and 102 (e.g., generating a spatiotemporal dithering sequence of P0>P2>P3>P0>P1>P2>P3 . . . as opposed to P0>P1>P2>P3>P0>P1>P2>P3 . . . ), the positive and negative polarity voltages used to drive the pixels 51 may be have substantially the same voltage magnitude. For example, if the pixels 51 are intended to be driven to a +3V voltage and a −3V voltage, the +3V (positive polarity) voltage may be actually driven at 3.0V as opposed to, for example, +3.1V. Similarly, the −3V (negative polarity) voltage may actually be driven at −3.0V as opposed to, for example, −2.9V. A further example of these techniques is illustrated with respect to the four pixel grids 107A, 107B, and 107C of FIG. 16. As illustrated, because the spatiotemporal dithering rotation phase 100 has been skipped or replaced by the spatiotemporal dithering rotation phase 102, the graphics processor 44 and/or dithering circuitry 48 may drive the four pixel grids 107B and 107C consecutively to a pixel intensity level of "1" by a positive polarity voltage, and vice-versa, for example, for a negative polarity voltage. This may thus reduce and/or substantially eliminate voltage and/or charge imbalance of the pixels 51 of the display 18, and, by extension, reduce and/or substantially eliminate image artifacts based thereon that may become apparent on the display 18.

Figure 17:
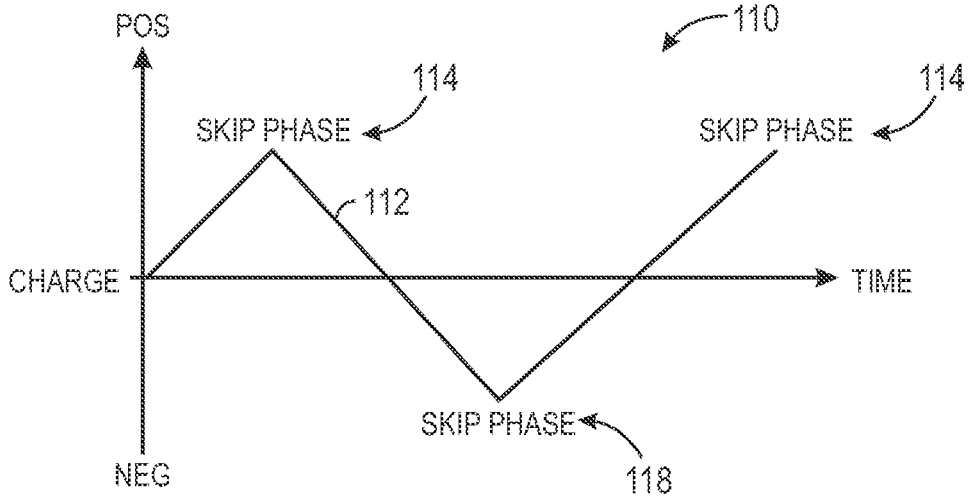
FIG. 17 is a plot diagram illustrating pixel charge versus time and notating the skipping of a spatiotemporal dithering rotation phase, in accordance with an embodiment.

Turning now to FIG. 17, which illustrates a pixel charge plot 110 generated, for example, by way of the graphics processor 44 and/or dithering circuitry 48 plotted as a function of time. As depicted by the pixel charge plot 110 of FIG. 17, when the pixel charge 112 reaches a positive polarity pixel charge threshold value 114 (e.g., corresponding to each of the positive polarity voltage driven pixels 51 per frame period), a negative polarity pixel charge threshold value 116 (e.g., corresponding to each of the negative polarity voltage driven pixels 51 per frame period), or other pixel charge threshold value, the graphics processor 44 and/or dithering circuitry 48 may skip one or more of the spatiotemporal dithering rotation phases 96, 98, 100, and 102 or alter one or more of the spatiotemporal dithering rotation phases 96, 98, 100, and 102 (e.g., P2 is skipped such that the spatiotemporal dithering sequence P0>P1>P2>P3 is altered to a spatiotemporal dithering sequence P0>P1>P3>P0) as frames of data are provided to the pixels 51 of the display 18.

In certain embodiments, the positive polarity pixel charge threshold value 114 and the negative polarity pixel charge threshold value 116 may be fixed or configurable values (e.g., arbitrary or variable changing values). Specifically, as previously discussed above, in certain embodiments, the graphics processor 44 and/or dithering circuitry 48 may include a counter that is incremented with each frame of a data provided to the pixels 51 of the until a configurable charge threshold on the individual pixels 51 of the display 18 is reached. Once the configurable pixel charge threshold value (e.g., positive polarity threshold value 114, negative polarity threshold value 116) is reached, the graphics processor 44 and/or dithering circuitry 48 may skip one or more spatiotemporal dithering rotation phases 96, 98, 100, and 102 or alter the sequence of the spatiotemporal dithering rotation phases 96, 98, 100, and 102 based on, for example, the pixel charge (e.g., pixel charge accumulation). In another embodiment, the graphics processor 44 and/or dithering circuitry 48 may measure and monitor the pixel charge (e.g., monitor how closely the real-time pixel charge is approaching the configurable thresholds), and may skip a spatiotemporal rotation phase 96, 98, 100, and 102 or alter the sequence of spatiotemporal phases 96, 98, 100, and 102 provided to the pixels 51 of the display 18 when the pixel charge approaches a pixel charge value less than the positive polarity pixel charge threshold value 114 or greater than the negative polarity pixel charge threshold value 114. In particular, the graphics processor 44 and/or dithering circuitry 48 may randomize the pixel charge threshold for which the skipping or alteration of the sequence of spatiotemporal phases may take place.

In other embodiments, as previously noted, the graphics processor 44 and/or dithering circuitry 48 may include a timer that tracks an N number of frames (e.g., a variable number of frames) per unit time (e.g., frames per second or frames per minute) of data provided to display 18, and may skip one or more spatiotemporal dithering rotation phases 96, 98, 100, and 102 or alter the sequence of the spatiotemporal dithering rotation phases 96, 98, 100, and 102 after the N number of frames are provided to the pixels 51 of the display 18. For example, in one embodiment, the graphics processor 44 and/or dithering circuitry 48 may skip or alter the sequence of the one or more of the spatiotemporal dithering rotation phases 96, 98, 100, and 102 once per minute, twice per minute, thrice per minute, four times per minute, five times per minute, and so forth. In this way, the presently disclosed techniques may prevent the pixel charge from exceeding the physical charge characteristics of the pixels 51, and instead be limited to a nominal pixel charge value (e.g., pixel charge value within the operational characteristic bounds of the pixels 51). This may thus reduce and/or substantially eliminate voltage and/or charge imbalance of the pixels 51 of the display 18, and, by extension, reduce and/or substantially eliminate image artifacts based thereon that may become apparent on the display 18.

Figure 18:
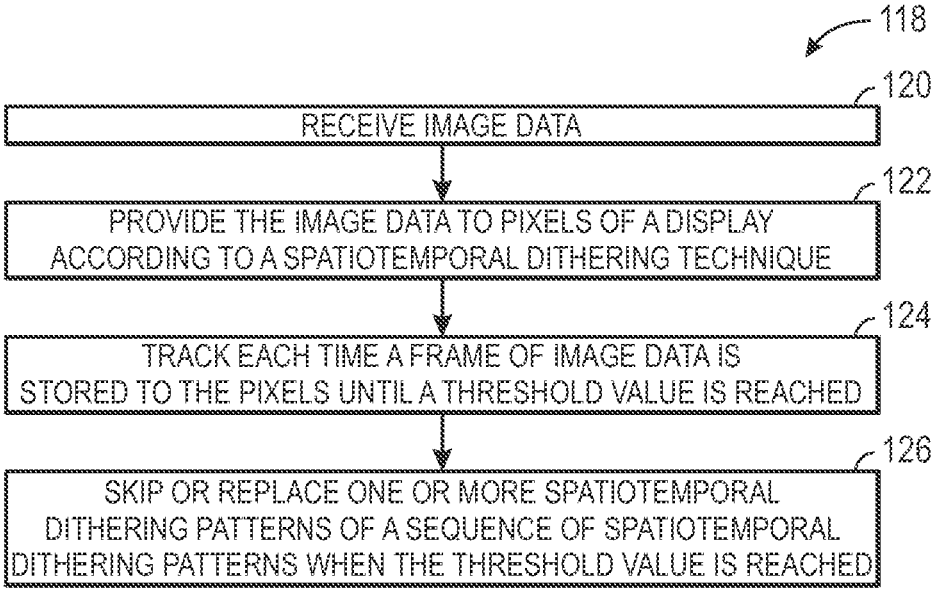
FIG. 18 is a flow diagram illustrating an embodiment of a process useful in reducing and/or substantially eliminating voltage or pixel charge imbalance due to spatiotemporal dithering, in accordance with an embodiment.

Turning now to FIG. 18, a flow diagram is presented, illustrating an embodiment of a process 118 useful in reducing and/or substantially eliminating voltage or pixel charge imbalance due to spatiotemporal dithering by using, for example, the graphics processor 44 and/or dithering circuitry 48 depicted in FIG. 7. The process 118 may include code or instructions stored in a non-transitory machine-readable medium (e.g., the memory 14) and executed, for example, by the graphics processor 44 and/or dithering circuitry 48 included in FIG. 7. The process 118 may begin with the graphics processor 44 and/or dithering circuitry 48 receiving (block 120) image data. For example, the graphics processor 44 and/or dithering circuitry 48 may receive image data from the processor(s) 12 to be provided to the display 18.

The process 118 may then continue with the graphics processor 44 and/or dithering circuitry 48 providing (block 122) the image data to pixels of a display according to a spatiotemporal dithering technique. For example, as discussed above with respect to FIGS. 13 and 14, the graphics processor 44 and/or dithering circuitry 48 may provide a spatiotemporal dithering rotation phase sequence 94 including, for example, a spatiotemporal dithering rotation phase 96 (e.g., "Phase 0" or "P0"), a spatiotemporal dithering rotation phase 98 (e.g., "Phase 1" or "P1"), a spatiotemporal dithering rotation phase 100 (e.g., "Phase 2" or "P2"), and a spatiotemporal dithering rotation phase 102 (e.g., "Phase 3" or "P3") useful in driving the pixels 51 of the display 18 over a number of frames (e.g., odd and even frames).

The process 118 may then continue with the graphics processor 44 and/or dithering circuitry 48 tracking (block 94) each time a frame of image data is provided to the pixels of the display until a threshold value is reached. For example, as discussed above with respect to FIG. 17, the graphics processor 44 and/or dithering circuitry 48 may include a counter that is incremented with each frame of a data provided to the pixels 51 of the until a predetermined (e.g., static) or configurable (e.g., variable) positive and negative charge threshold on the individual pixels 51 is reached. In other embodiments, the graphics processor 44 and/or dithering circuitry 48 may include a timer that tracks the number of frames provided to the pixels 51 of the display 18 per unit time, or may measure and monitor the pixel charge (e.g., monitor how closely the real-time pixel charge is approaching the configurable thresholds). The process 118 may then conclude with the graphics processor 44 and/or dithering circuitry 48 skipping or altering (block 96) the providing of one or more spatiotemporal dithering frame patterns of a predetermined sequence of spatiotemporal dithering frame patterns when the threshold value is reached.

For example, as previously discussed, for a four frame spatiotemporal sequence (although, in other embodiments, the spatiotemporal sequence may include any number of frames such as, for example, an eight frame sequence, a twenty-four frame sequence, a thirty-two frame sequence, and so on), the graphics processor 44 and/or dithering circuitry 48 may skip or alter one or more of the spatiotemporal dithering rotation phases 96, 98, 100, and 102 of the sequence 94 (e.g., the sequence P0>P1>P2>P3 may become P0>P1>P3>P0 when P2 is skipped, and so on and so forth). In this way, the presently disclosed techniques may prevent the pixel charge from exceeding the physical charge characteristics of the pixels 51, and instead be limited to a nominal pixel charge value (e.g., pixel charge value within the operational characteristic bounds of the pixels 51). This may thus reduce and/or substantially eliminate voltage and/or charge imbalance of the pixels 51 of the display 18, and, by extension, reduce and/or substantially eliminate image artifacts based thereon that may become apparent on the display 18.

While the various embodiments may be susceptible to various modifications and alternative forms, specific embodiments have been shown by way of example in the drawings and have been described in detail herein. However, it should be understood that the claims are not intended to be limited to the particular forms disclosed. Rather, the claims are to cover all modifications, equivalents, and alternatives falling within the spirit and scope of the disclosure.

What is claimed is:

1. A method of operating a display, comprising:

providing positive polarity data signals and negative polarity data signals via a processor to a plurality of pixels of the display during a first frame period, wherein the first frame period corresponds a first spatiotemporal rotation phase;

driving a first subset of pixels of the plurality of pixels to a first intensity level and a second subset of pixels of the plurality of pixels to a second intensity level during the first frame period;

providing the positive polarity data signals and the negative polarity data signals to the plurality of pixels of the display during a second frame period, wherein the second frame period corresponds a second spatiotemporal rotation phase;

counting a first number of frames using the first spatiotemporal rotation phase during a unit time and a second number of frames using the second spatiotemporal rotation phase during the unit time; and driving a third subset of pixels to the second intensity level and a fourth subset of pixels to the first intensity level during the second frame period, wherein the third subset of pixels comprises first rotated pixels that are rotated from the first subset of pixels within quadrants of the plurality of pixels, and the fourth subset of pixels comprises second rotated pixels that are rotated from the second subset of pixels within quadrants of the plurality of pixels, a spatiotemporal rotation phase sequence provided to the display comprises the first spatiotemporal rotation phase and the second spatiotemporal rotation phase, and wherein the processor is configured to replace one of the first spatiotemporal rotation phase and the second spatiotemporal rotation phase of the spatiotemporal rotation phase sequence with another spatiotemporal rotation phase during the first frame period or the second frame period, wherein replacing one of the first spatiotemporal rotation phase and the second spatiotemporal rotation phase comprises replacing one of the first spatiotemporal rotation phase and the second spatiotemporal rotation phase of the spatiotemporal rotation phase sequence each time a measured pixel charge value reaches a pixel charge threshold value and based at least in part on the first number or the second number.

2. The method of claim 1, wherein replacing one of the first spatiotemporal rotation phase and the second spatiotemporal rotation phase of the spatiotemporal rotation phase sequence with another spatiotemporal rotation phase comprises restarting the spatiotemporal rotation phase sequence.

3. The method of claim 1, wherein replacing one of the first spatiotemporal rotation phase and the second spatiotemporal rotation phase comprises replacing one of the first spatiotemporal rotation phase and the second spatiotemporal rotation phase of the spatiotemporal rotation phase sequence each time a charge on the pixels of the display reaches a positive polarity threshold value as the pixel charge threshold value.

4. The method of claim 1, wherein replacing one of the first spatiotemporal rotation phase and the second spatiotemporal rotation phase comprises replacing one of the first spatiotemporal rotation phase and the second spatiotemporal rotation phase of the spatiotemporal rotation phase sequence each time a charge on the pixels of the display reaches a negative polarity threshold value as the pixel charge threshold value.

5. The method of claim 1, wherein replacing one of the first spatiotemporal rotation phase and the second spatiotemporal rotation phase during the first frame period or the second frame period comprises providing the second spatiotemporal rotation phase during the first frame period as the another spatiotemporal rotation phase.

6. The method of claim 1, wherein replacing one of the first spatiotemporal rotation phase and the second spatiotemporal rotation phase during the first frame period or the second frame period comprises providing the first spatiotemporal rotation phase during the second frame period.

7. The method of claim 1, wherein replacing one of the first spatiotemporal rotation phase and the second spatiotemporal rotation phase comprises reducing or substantially eliminating an occurrence of image artifacts on the display.

8. An electronic device, comprising:

a processor configured to generate and transmit image data;

a display configured to display the image data; and display control circuitry configured to receive the image data, and to:

generate and transmit a first sequence of spatial and temporal dithering frames based on the image data, wherein the first sequence of spatial and temporal dithering frames comprises a plurality of spatiotemporal dithering patterns each corresponding to a respective frame period, wherein the spatial and temporal dithering frames sequentially rotate pixel intensity levels through at least four pixels of a plurality of pixels by quarter turns of at least four pixel intensity levels of the pixel intensity levels;

implement a timer configured to count numbers of frames each corresponding to respective spatiotemporal dithering patterns of the plurality of spatiotemporal dithering patterns during a unit time; and generate and transmit a second sequence of spatial and temporal dithering frames based on the image data, wherein, in the second sequence of spatial and temporal dithering frames, the display control circuitry is configured to omit at least one of the plurality of spatiotemporal dithering patterns during its respective frame period in place of another one of the plurality of spatiotemporal dithering patterns each time a measured pixel charge value on pixels of the display reaches a threshold value and based at least in part on a corresponding one of the counted numbers.

9. The electronic device of claim 8, wherein the display control circuitry is configured to omit the at least one of the plurality of spatiotemporal dithering patterns each time the measured pixel charge value reaches a positive polarity threshold value as the threshold value.

10. The electronic device of claim 8, wherein the display control circuitry is configured to omit the at least one of the plurality of spatiotemporal dithering patterns each time the measured pixel charge value reaches a negative polarity threshold value as the threshold value.

11. The electronic device of claim 8, wherein the plurality of spatiotemporal dithering patterns are generated on a frame by frame basis.

12. The electronic device of claim 8, wherein the display control circuitry is configured to periodically omit the at least one of the plurality of spatiotemporal dithering patterns.

13. The electronic device of claim 8, wherein the display control circuitry is configured to aperiodically omit the at least one of the plurality of spatiotemporal dithering patterns.

14. A method for reducing image artifacts on an electronic display utilizing spatiotemporal dithering, comprising:

receiving image data via a graphics processor;

providing the image data to pixels of the electronic display according to a spatiotemporal dithering technique, wherein the spatiotemporal dithering technique comprises rotating pixel intensity values within each quadrant of pixels between image frames of the image data;

measuring a charge present on a pixel of the electronic display to determine a measured pixel charge value;

determining whether the measured pixel charge value reaches a polarity charge threshold value;

counting a number of frames displayed for each of one or more spatiotemporal dithering frame patterns during a unit time; and replacing the providing of the one or more spatiotemporal dithering frame patterns of a predetermined sequence of spatiotemporal dithering frame patterns when the polarity charge threshold value is reached and based at least in part on the numbers corresponding to the one or more spatiotemporal dithering frame patterns.

15. The method of claim 14, wherein providing the image data to pixels of the electronic display according to the spatiotemporal dithering technique comprises providing positive polarity signals and negative polarity signals to the pixels of the electronic display.

16. The method of claim 15, wherein providing the image data to pixels of the electronic display according to the spatiotemporal dithering technique comprises driving a first subset of the pixels to a first intensity level and a second subset of the pixels to a second intensity level.

17. The method of claim 14, wherein altering the providing of the one or more spatiotemporal dithering frame patterns comprises altering the providing of the one or more spatiotemporal dithering frame patterns when a positive polarity charge threshold value as the polarity charge threshold value is reached.

18. The method of claim 14, wherein altering the providing of the one or more spatiotemporal dithering frame patterns comprises altering the providing of the one or more spatiotemporal dithering frame patterns when a negative polarity charge threshold value as the polarity charge threshold value is reached.

19. The method of claim 14, wherein altering the providing of the one or more spatiotemporal dithering frame patterns comprises altering the providing of the one or more spatiotemporal dithering frame patterns when the measured pixel charge value is greater than a negative polarity charge threshold value as the polarity charge threshold value and less than a positive polarity charge threshold value as the polarity charge threshold value.

20. An electronic device, comprising:

pixel data dithering circuitry configured to:

generate and transmit a series of spatiotemporal dithering rotation phases during a first iteration of a plurality of iterations, wherein the series of spatiotemporal dithering rotation phases comprises a first spatiotemporal dithering rotation phase: P0 comprising a plurality of pixel intensity values organized into quadrants, a second spatiotemporal dithering rotation phase: P1, a third spatiotemporal dithering rotation phase: P2, and a fourth spatiotemporal dithering rotation phase: P3, and wherein an order of the series of spatiotemporal dithering rotation phases is expressed as: P0>P1>P2>P3, wherein P1 comprises the plurality of pixel intensity values that are rotated within each quadrant from P0, P2 comprises the plurality of pixel intensity values that are rotated within each quadrant from P1, and P3 comprises the plurality of pixel intensity values that are rotated within each quadrant from P2;

counting a number of frames to track the number of frames using each of P0, P1, P2, and P3; and generate and transmit the series of spatiotemporal dithering rotation phases during a second iteration of the plurality of iterations, wherein, during the second iteration, at least one of the spatiotemporal dithering rotation phases in the order: P0>P1>P2>P3 is skipped when a measured pixel charge value reaches a pixel charge threshold value and based at least in part on the number.

21. The electronic device of claim 20, wherein a total number of spatiotemporal dithering rotation phases of the series of spatiotemporal dithering rotation phases corresponds to a number of frame periods.

22. The electronic device of claim 20, wherein the plurality of pixel intensity values that are rotated within each quadrant from P0 to P1 by rotating the quadrant by ninety degrees, the plurality of pixel intensity values that are rotated within each quadrant from P1 to P2 by rotating the quadrant by ninety degrees, and the plurality of pixel intensity values that are rotated within each quadrant from P3 to P4 by rotating the quadrant by ninety degrees.

23. A non-transitory computer-readable medium having instructions stored thereon, that when executed, is configured to cause a processor to:

cause an electronic display to receive positive polarity signals and negative polarity signals during a first frame period, wherein the first frame period corresponds a first spatiotemporal rotation phase comprising a plurality of pixel intensity values in quadrants of pixel intensity values;

cause the electronic display to receive the positive polarity signals and the negative polarity signals during a second frame period, wherein the second frame period corresponds a second spatiotemporal rotation phase, wherein the second spatiotemporal rotation phase comprises the plurality of pixel intensity values rotated by a quarter turn within the quadrants;

count a first number of frames using the first spatiotemporal rotation phase during a unit time and a second number of frames using the second spatiotemporal rotation phase during the unit time; and cause the electronic display to receive a spatiotemporal rotation phase sequence comprising the first spatiotemporal rotation phase and the second spatiotemporal rotation phase, wherein at least one of the first spatiotemporal rotation phase and the second spatiotemporal rotation phase of the spatiotemporal rotation phase sequence is replaced with another spatiotemporal rotation phase during the first frame period or the second frame period based at least in part on a measured pixel charge value reaches a pixel charge threshold value, the first number, and the second number.

* * * * *